US010961610B2

(12) United States Patent
Lee et al.

(10) Patent No.: US 10,961,610 B2
(45) Date of Patent: Mar. 30, 2021

(54) NON-MAGNETIC STEEL MATERIAL HAVING EXCELLENT HOT WORKABILITY AND MANUFACTURING METHOD THEREFOR

(71) Applicant: POSCO, Pohang-si (KR)

(72) Inventors: Un-Hae Lee, Gwangyang-si (KR); Sung-Kyu Kim, Gwangyang-si (KR); Soon-Gi Lee, Gwangyang-si (KR); Yong-Jin Kim, Gwangyang-si (KR); Hong-Yeol Oh, Gwangyang-si (KR)

(73) Assignee: POSCO, Pohang-si (KR)

( * ) Notice: Subject to any disclaimer, the term of this patent is extended or adjusted under 35 U.S.C. 154(b) by 199 days.

(21) Appl. No.: 16/061,196

(22) PCT Filed: Dec. 23, 2016

(86) PCT No.: PCT/KR2016/015121

§ 371 (c)(1),
(2) Date: Jun. 11, 2018

(87) PCT Pub. No.: WO2017/111510

PCT Pub. Date: Jun. 29, 2017

(65) Prior Publication Data

US 2018/0363108 A1 Dec. 20, 2018

(30) Foreign Application Priority Data

Dec. 23, 2015 (KR) ..... 10-2015-0184757
Dec. 22, 2016 (KR) ..... 10-2016-0176294

(51) Int. Cl.
*C22C 38/38* (2006.01)
*C22C 38/00* (2006.01)
(Continued)

(52) U.S. Cl.
CPC ..... *C22C 38/38* (2013.01); *C21D 6/005* (2013.01); *C21D 8/02* (2013.01); *C21D 8/0205* (2013.01);
(Continued)

(58) Field of Classification Search
CPC .... C21D 2211/001; C21D 6/005; C21D 8/02; C21D 8/0205; C21D 8/0226; C21D 9/46;
(Continued)

(56) References Cited

U.S. PATENT DOCUMENTS 5,647,922 A 7/1997 Kim et al.
2008/0035248 A1* 2/2008 Cugy ..... C21D 8/0205 148/546
(Continued)

FOREIGN PATENT DOCUMENTS

CN 104745952 A 7/2015
EP 2 796 585 A1 10/2014
(Continued)

OTHER PUBLICATIONS

Extended European Search Report issued in European Application No. 16879377.6 dated Nov. 7, 2018.
(Continued)

*Primary Examiner* — Jenny R Wu
(74) *Attorney, Agent, or Firm* — Morgan, Lewis & Bockius LLP

(57) ABSTRACT

Provided according to one embodiment of the present invention are a non-magnetic steel material and a method for manufacturing the same. The steel material comprises 15-27 wt % of manganese, 0.1-1.1 wt % of carbon, 0.05-0.50 wt % of silicon, 0.03 wt % or less (0% exclusive) of phosphorus, 0.01 wt % or less (0% exclusive) of sulfur, 0.050 wt % or less (0% exclusive) of aluminum, 5 wt % or less (0% inclusive) of chromium, 0.01 wt % or less (0% inclusive) of
(Continued)

| Class | Score | State |
|---|---|---|
| (a) | 1 | No Crack |
| (b) | 1.5 | Fine Defects |
| (c) | 2 | Crack Propagation |

boron, 0.1 wt % or less (0% exclusive) of nitrogen, and a balance amount of Fe and inevitable impurities, has an index of sensitivity of 3.4 or less, the index of sensitivity being represented by the following relational expression (1): [Relational expression 1]—0.451+34.131*P+111.152*Al−799.483*B+0.526*Cr≤3.4 (wherein [P], [Al], [B] and [Cr] each mean a wt % of corresponding elements), and contains a microstructure with austenite at an area fraction of 95% or greater therein.

16 Claims, 2 Drawing Sheets

(51) Int. Cl.

| | |
|---|---|
| ***C22C 38/06*** | (2006.01) |
| ***C21D 9/46*** | (2006.01) |
| ***C22C 38/18*** | (2006.01) |
| ***C21D 6/00*** | (2006.01) |
| ***C21D 8/02*** | (2006.01) |
| ***C22C 38/04*** | (2006.01) |
| ***C22C 38/02*** | (2006.01) |

(52) U.S. Cl.
CPC ..... *C21D 8/0226* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/18* (2013.01); *C21D 2211/001* (2013.01)

(58) Field of Classification Search
CPC ..... C22C 38/00; C22C 38/001; C22C 38/02; C22C 38/04; C22C 38/06; C22C 38/18; C22C 38/38
See application file for complete search history.

(56) References Cited

U.S. PATENT DOCUMENTS

| | | | | |
|---|---|---|---|---|
| 2013/0156628 | A1 | 6/2013 | Forbes Jones et al. | |
| 2015/0211088 | A1* | 7/2015 | Kim | C22C 38/001 148/603 |

FOREIGN PATENT DOCUMENTS

| | | | | | |
|---|---|---|---|---|---|
| JP | 54116322 | A | * | 9/1979 | C21D 8/065 |
| JP | 02190445 | A | * | 7/1990 | |
| JP | H03-13544 | A | | 1/1991 | |
| JP | H04-259325 | A | | 9/1992 | |
| JP | H06-057379 | A | | 3/1994 | |
| JP | H10-251807 | A | | 9/1998 | |
| JP | 2011-230182 | A | | 11/2011 | |
| JP | 2011230182 | A | * | 11/2011 | |
| JP | 2012-072499 | A | | 4/2012 | |
| JP | 2013-023743 | A | | 2/2013 | |
| JP | 2014-205907 | A | | 10/2014 | |
| JP | 2014205907 | A | * | 10/2014 | |
| JP | 2014205908 | A | * | 10/2014 | |
| JP | 2015-507090 | A | | 3/2015 | |
| JP | 2015-196837 | A | | 11/2015 | |
| KR | 10-1991-0012278 | A | | 8/1991 | |
| KR | 95-0026569 | U | | 10/1995 | |
| KR | 10-2013-0073736 | A | | 7/2013 | |
| KR | 10-2013-0074384 | A | | 7/2013 | |
| KR | 10-2014-0103107 | A | | 8/2014 | |
| KR | 10-2015-0075331 | A | | 7/2015 | |

OTHER PUBLICATIONS

International Search Report dated Mar. 6, 2017 issued in International Patent Application No. PCT/KR2016/015121 (with English translation).
Japanese Office Action dated Aug. 13, 2019 issued in Japanese Patent Application No. 2018-532026.
Chinese Office Action dated Aug. 16, 2019 issued in Chinese Patent Application No. 201680075986.6 (with English translation).

* cited by examiner

[Fig. 1]
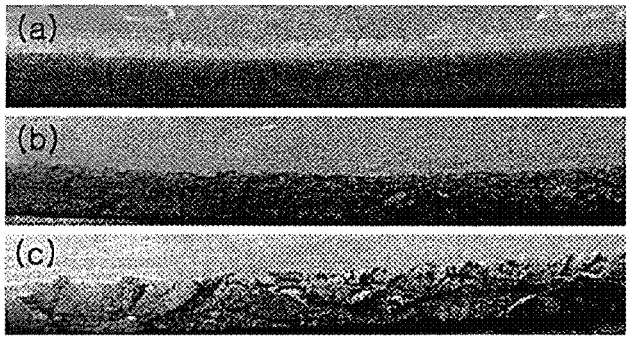
| Class | Score | State |
|---|---|---|
| (a) | 1 | No Crack |
| (b) | 1.5 | Fine Defects |
| (c) | 2 | Crack Propagation |
[Fig. 2]
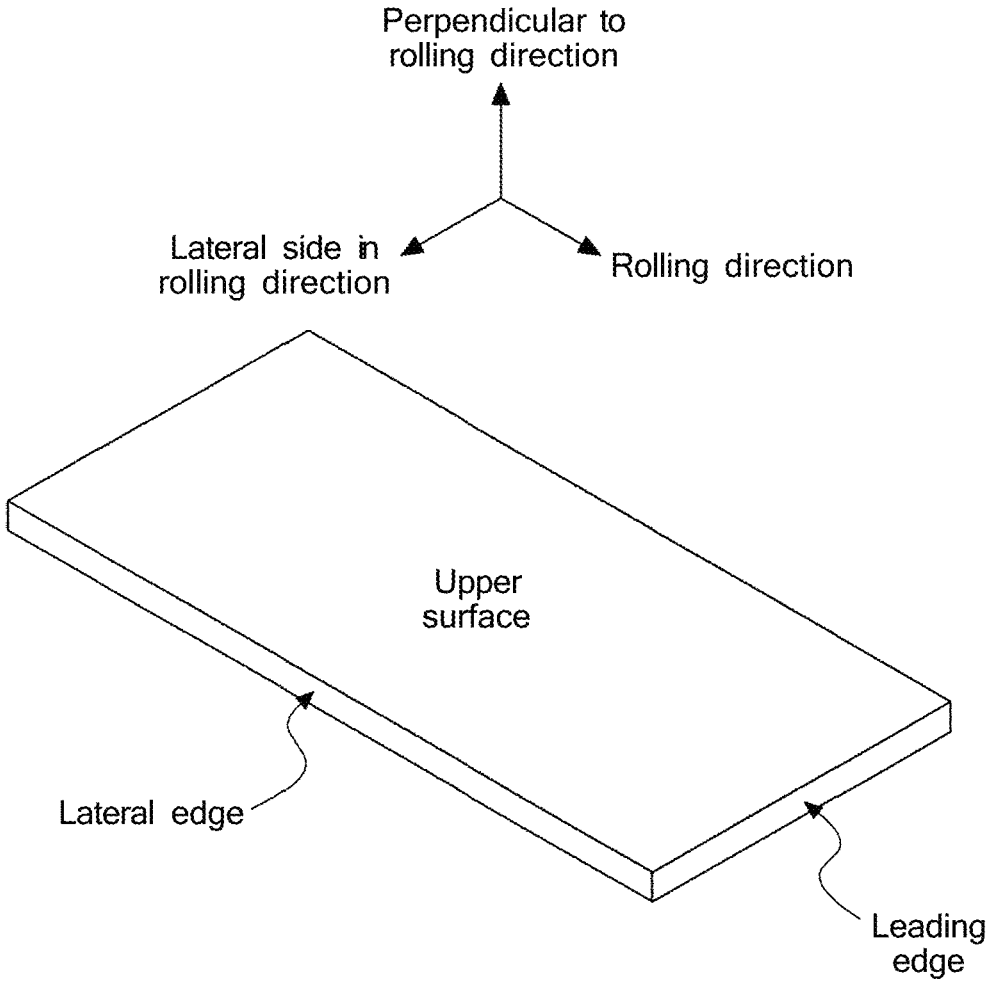

【Fig. 3】
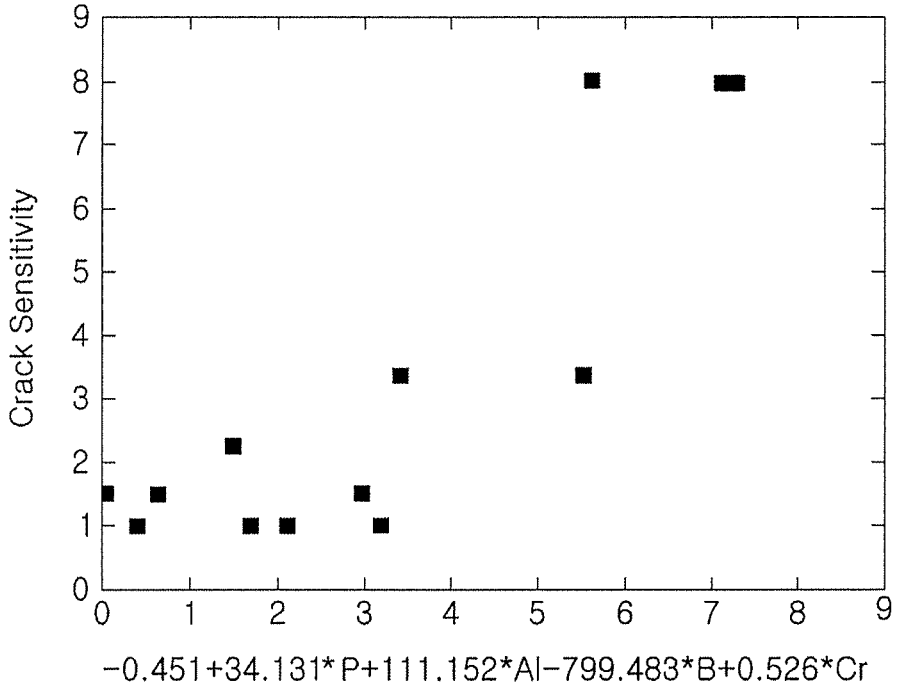

NON-MAGNETIC STEEL MATERIAL HAVING EXCELLENT HOT WORKABILITY AND MANUFACTURING METHOD THEREFOR

CROSS REFERENCE

This patent application is the U.S. National Phase under 35 U.S.C. § 371 of International Application No. PCT/KR2016/015121, filed on Dec. 23, 2016, which claims the benefit of Korean Patent Application No. 10-2015-0184757, filed on Dec. 23, 2015 and Korean Patent Application No. 10-2016-0176294, filed on Dec. 22, 2016, the entire contents of each are hereby incorporated by reference.

TECHNICAL FIELD

The present disclosure relates to a non-magnetic steel material having high hot workability and a method for manufacturing the non-magnetic steel material.

BACKGROUND ART

Transformer structures include a case and a lock plate, and steel materials used for such transformer structures are required to have high non-magnetic characteristics.

Recently, steel materials having high non-magnetic characteristics in which austenite is stabilized by adding large amounts of manganese (Mn) and carbon (C) while entirely excluding chromium (Cr) and nickel (Ni) have been developed. Austenite is a paramagnetic substance having low magnetic permeability and is more non-magnetic than ferrite.

High manganese (Mn) steel materials having austenite in which carbon (C) is contained in large amounts are suitable for use as non-magnetic steel materials due to high stability of austenite.

However, if elements such as aluminum (Al) or phosphorus (P), remaining in manufacturing processes of high manganese steel materials, are included in austenite in large amounts, the crack sensitivity of the steel materials increases at high temperatures. This is due to low hot ductility and internal grain boundary oxidation at high temperatures. High crack sensitivity has a large influence on the surface quality of steel materials at room temperature.

Therefore, it is necessary to develop a non-magnetic steel material having low crack sensitivity and high surface qualities.

DISCLOSURE

Technical Problem

An aspect of the present disclosure may provide a non-magnetic steel material having high hot workability, low hot crack sensitivity, and high surface qualities.

Another aspect of the present disclosure may provide a method for manufacturing a non-magnetic steel material having high hot workability, low hot crack sensitivity, and high surface qualities.

Technical Solution

According to an aspect of the present disclosure, a non-magnetic steel material having high hot workability may include manganese (Mn): 15 wt % to 27 wt %, carbon (C): 0.1 wt % to 1.1 wt %, silicon (Si): 0.05 wt % to 0.50 wt %, phosphorus (P): 0.03 wt % or less (excluding 0%), sulfur (S): 0.01 wt % or less (excluding 0%), aluminum (Al) : 0.050 wt % or less (excluding 0%), chromium (Cr): 5 wt % or less (including 0%), boron (B): 0.01 wt % or less (including 0%), nitrogen (N): 0.1 wt % or less (excluding 0%), and a balance of iron (Fe) and inevitable impurities, wherein the non-magnetic steel material has a composition index of sensitivity expressed by Formula 1 below within a range of 3.4 or less, $$-0.451+34.131*P+111.152*Al-799.483*B+0.526*Cr3.4 \quad \text{[Formula 1]}$$

where each of [P], [Al], [B], and [Cr] is a weight percent (wt %) of a corresponding element, wherein the non-magnetic steel material has a microstructure including austenite in an area fraction of 95% or greater.

The austenite may have an average grain size of 10 μm or greater.

According to another aspect of the present disclosure, a method for manufacturing a non-magnetic steel material having high hot workability may include:

preparing a slab, the slab including manganese (Mn): 15 wt % to 27 wt %, carbon (C) : 0.1 wt % to 1.1 wt %, silicon (Si): 0.05 wt % to 0.50 wt %, phosphorus (P): 0.03 wt % or less (excluding 0%), sulfur (S): 0.01 wt % or less (excluding 0%), aluminum (Al): 0.050 wt % or less (excluding 0%), chromium (Cr) : 5 wt % or less (including 0%), boron (B): 0.01 wt % or less (including 0%), nitrogen (N): 0.1 wt % or less (excluding 0%), and a balance of iron (Fe) and inevitable impurities, the slab having a composition index of sensitivity expressed by Formula 1 below within a range of 3.4 or less, $$-0.451+34.131*P+111.152*Al-799.483*B+0.526*Cr3.4 \quad \text{[Formula 1]}$$

where each of [P], [Al], [B], and [Cr] is a weight percent (wt %) of a corresponding element;

reheating the slab to a temperature within a range of 1050° C. to 1250° C.;

hot rolling the reheated slab to obtain a hot-rolled steel material; and cooling the hot-rolled steel material.

Advantageous Effects

Embodiments of the present disclosure may provide a non-magnetic steel material having uniform austenite, good non-magnetic characteristics, and high surface qualities owing to low crack sensitivity, and a method for manufacturing the non-magnetic steel material.

DESCRIPTION OF DRAWINGS

FIG. 1 is a view illustrating surface quality scores for measuring crack sensitivity, a score of 1 indicating a state having no surface crack, a score of 1.5 indicating a state having fine defects, and a score of 2 indicating a state in which cracks propagate and large cracks are present.

FIG. 2 is a schematic example view illustrating crack sensitivity measurement portions for crack sensitivity evaluation.

FIG. 3 is a graph illustrating a relationship between crack sensitivity and a composition index of sensitivity.

BEST MODE

Embodiments of the present disclosure will now be described in detail.

Rather, these embodiments are provided so that this disclosure will be thorough and complete, and will fully convey the scope of the disclosure to those skilled in the art.

The disclosure may, however, be exemplified in many different forms and should not be construed as being limited to the specific embodiments set forth herein.

It will be further understood that the terms "comprises" and/or "comprising" used herein specify the presence of stated features or elements, but do not preclude the presence or addition of one or more other features or elements.

Hereinafter, a non-magnetic steel material of the present disclosure having high hot workability will be described in detail.

According to an aspect of the present disclosure, the non-magnetic steel material having high hot workability includes: manganese (Mn) : 15 wt % to 27 wt %, carbon (C) : 0.1 wt % to 1.1 wt %, silicon (Si): 0.05 wt % to 0.50 wt %, phosphorus (P): 0.03 wt % or less (excluding 0%), sulfur (S): 0.01 wt % or less (excluding 0%), aluminum (Al) : 0.050 wt % or less (excluding 0%), chromium (Cr): 5 wt % or less (including 0%), boron (B): 0.01 wt % or less (including 0%), nitrogen (N): 0.1 wt % or less (excluding 0%), and the balance of iron (Fe) and inevitable impurities, wherein the non-magnetic steel material has a composition index of sensitivity expressed by Formula 1 below within the range of 3.4 or less and has a microstructure having austenite in an area fraction of 95% or greater.

$$-0.451+34.131*P+111.152*Al-799.483*B+0.526*Cr3.4 \quad \text{[Formula 1]}$$

(where each of [P], [Al], [B], and [Cr] is the weight percent (wt %) of the corresponding element)

First, the alloying elements and the contents of the alloying elements of the steel material will be described.

Manganese (Mn): 15 wt % to 27 wt %

Preferably, the content of manganese (Mn) is adjusted to be within the range of 15 wt % to 27 wt %.

Manganese (Mn) is an element stabilizing austenite.

Manganese (Mn) may be added in an amount of 15 wt % or greater to stabilize austenite at very low temperatures.

If the content of manganese (Mn) is less than 15 wt %, ε-martensite being a metastable phase may be formed in a steel material having a low content of carbon (C), and may be easily transformed into α'-martensite at a very low temperature by strain induced transformation. Thus, the toughness of the steel material may decrease.

Furthermore, in the case of a steel material having a content of carbon (C) increased to guarantee toughness, physical properties of the steel material may markedly deteriorate because of precipitation of carbides.

If the content of manganese (Mn) is greater than 27 wt %, manufacturing costs increase, and thus the economic feasibility of the steel material may decrease.

More preferably, the content of manganese (Mn) may be within the range of 15 wt % to 25 wt %, and even more preferably within the range of 17 wt % to 25 wt %.

Carbon (C): 0.1 wt % to 1.1 wt %

Preferably, the content of carbon (C) is adjusted to be within the range of 0.1 wt % to 1.1 wt %.

Carbon (C) is an element stabilizing austenite and increasing the strength of the steel material.

Carbon (C) may decrease transformation points Ms and Md at which austenite transforms into ε-martensite or α'-martensite during a cooling or processing process.

If the content of carbon (C) is less than 0.1 wt %, the stability of austenite is insufficient to obtain stabile austenite at very low temperatures, and austenite may be easily transformed into ε-martensite or α'-martensite by external stress through strain induced transformation, thereby decreasing the toughness and strength of the steel material.

If the content of carbon (C) is greater than 1.1 wt %, the toughness of the steel material may markedly decrease because of precipitation of carbides, and the strength of the steel material may excessively increase to result in a decrease in the workability of the steel material.

More preferably, the content of carbon (C) may be within the range of 0.1 wt % to 1.0 wt %, and even more preferably within the range of 0.1 wt % to 0.8 wt %.

Silicon (Si): 0.05 wt % to 0.5 wt %

Like aluminum (Al), silicon (Si) is an element inevitably added in very small amounts as a deoxidizer. If the content of silicon (Si) is excessive, oxides are formed along grain boundaries which may decrease high-temperature ductility and may decrease surface quality by causing cracks. However, costs may be excessively incurred to decrease the content of silicon (Si) in steel, and thus it may be preferable that the lower limit of the content of silicon (Si) be set to be 0.05%. Silicon (Si) is more oxidable than aluminum (Al), and thus if the content of silicon (Si) is greater than 0.5%, oxides may be formed which cause cracks decreasing surface quality. Therefore, it may be preferable that the content of silicon (Si) be adjusted to be within the range of 0.05 wt % to 0.5%.

Chromium (Cr): 5 wt % or less (including 0%)

If chromium (Cr) is added to the steel material in an appropriate amount, chromium (Cr) stabilizes austenite and thus improves the low-temperature impact toughness of the steel material. In addition, chromium (Cr) dissolves in austenite and thus increases the strength of the steel material. Furthermore, chromium (Cr) improves the corrosion resistance of the steel material. However, chromium (Cr) is a carbide forming element. Particularly, chromium (Cr) leads to the formation of carbides along grain boundaries of austenite and thus decreases low-temperature impact toughness. Therefore, the content of chromium (Cr) may be determined by considering a relationship with carbon (C) and other elements, and since chromium (Cr) is an expensive element, it may be preferable that the content of chromium (Cr) be adjusted to be 5 wt % or less.

More preferably, the content of chromium (Cr) may be within the range of 0 wt % to 4 wt %, and even more preferably within the range of 0.001 wt % to 4 wt %.

Boron (B): 0.01 wt % or less (Including 0%)

Preferably, the content of boron (B) may be adjusted to be within the range of 0.01 wt % or less.

Boron (B) is an element strengthening austenite grain boundaries.

Even a small amount of boron (B) may strengthen austenite grain boundaries and may thus decrease the crack sensitivity of the steel material at high temperatures. To improve surface quality by austenite grain boundary strengthening, the content of boron (B) may preferably be 0.0005 wt % or greater.

However, if the content of boron (B) is greater than 0.01%, segregation may occur along austenite grain boundaries, and thus the crack sensitivity of the steel material may increase at high temperatures, thereby decreasing the surface quality of the steel material.

Aluminum (Al): 0.050 wt % or Less (Excluding 0%)

Preferably, the content of aluminum (Al) may be adjusted to be within the range of 0.05 wt % or less (excluding 0%).

Aluminum (Al) is added as a deoxidizer. Aluminum (Al) may form precipitate by reacting with carbon (C) or nitrogen (N) and may thus decrease hot workability. Thus, the content of aluminum (Al) may preferably be adjusted to be 0.05 wt % or less (excluding 0%). More preferably, the content of aluminum (Al) may be within the range of 0.005 wt % to 0.05 wt %.

Sulfur (S): 0.01 wt % or Less (Excluding 0%)

The content of sulfur (S) may be adjusted to be 0.01% or less for controlling the amounts of inclusions. If the content of sulfur (S) is greater than 0.01%, hot embrittlement may occur.

Phosphorus (P): 0.03 wt % or Less (Excluding 0%)

Phosphorus (P) easily segregates and leads to cracks during a casting process. To prevent this, the content of phosphorus (P) is adjusted to be 0.03% or less. If the content of phosphorus (P) is greater than 0.03%, castability may decrease, and thus the upper limit of the content of phosphorus (P) is set to be 0.03%.

Nitrogen (N): 0.1 wt % or Less (Excluding 0%)

Like carbon (C), nitrogen (N) is an element stabilizing austenite and improving toughness. In addition, like carbon (C), nitrogen (N) is very effective in improving strength by the effect of solid solution strengthening or the formation of precipitate. However, if the content of nitrogen (N) is greater than 0.1%, physical properties or surface quality of the steel material deteriorate because of coarsening of carbonitrides coarsen, and thus it may be preferable that the upper limit of the content of nitrogen (N) be set to be 0.1 wt %. More preferably, the content of nitrogen (N) may be within the range of 0.001 wt % to 0.06 wt %, and even more preferably within the range of 0.005 wt % to 0.03 wt %.

In the present disclosure, the steel material includes the balance of iron (Fe) and inevitable impurities.

Impurities of raw materials or manufacturing environments may be inevitably included in the steel material, and such impurities may not be removed from the steel material.

Such impurities are well-known to those of ordinary skill in the steel manufacturing industry, and thus descriptions thereof will not be given in the present disclosure.

According to the aspect of the present disclosure, the non-magnetic austenitic steel material having high hot workability has a composition index of sensitivity expressed by Formula 1 below within the range of 3.4 or less.

$$-0.451+34.131*P+111.152*Al-799.483*B+0.526*Cr3.4 \quad \text{[Formula 1]}$$

(where each of [P], [Al], [B], and [Cr] is the weight percent (wt %) of the corresponding element)

If the composition index of sensitivity expressed by Formula 1 is greater than 3.4, cracking may easily occur and propagate, thereby increasing surface defects of products.

According to the aspect of the present disclosure, the non-magnetic austenitic steel material having high hot workability has austenite in an area fraction of 95% or greater.

Austenite, which is a paramagnetic substance having low magnetic permeability and is more non-magnetic than ferrite, is a key microstructure for guaranteeing non-magnetic characteristics.

If the area fraction of austenite is less than 95%, it may be difficult to guarantee non-magnetic characteristics.

The average grain size of austenite may be 10 μm or greater.

The grain size of austenite obtainable through a manufacturing process of the present disclosure is 10 μm or greater, and since the strength of the steel material may decrease if the grain size markedly increases, it may be preferable that the grain size of austenite be 60 μm or less.

According to the aspect of the present disclosure, the non-magnetic steel material having high hot workability may include one or more of precipitates and ε-martensite in an area fraction of 5% or less.

If the area fraction of one or more of precipitates and ε-martensite is greater than 5%, the toughness and ductility of the steel material may decrease.

Hereinafter, a method for manufacturing a non-magnetic steel material having high hot workability will be described in detail according to the present disclosure.

According to another aspect of the present disclosure, the method for manufacturing a non-magnetic steel material having high hot workability includes:

preparing a slab, the slab including manganese (Mn): 15 wt % to 27 wt %, carbon (C) : 0.1 wt % to 1.1 wt %, silicon (Si): 0.05 wt % to 0.50 wt %, phosphorus (P) : 0.03 wt % or less (excluding 0%), sulfur (S): 0.01 wt % or less (excluding 0%), aluminum (Al): 0.050 wt % or less (excluding 0%), chromium (Cr) : 5 wt % or less (including 0%), boron (B): 0.01 wt % or less (including 0%), nitrogen (N) : 0.1 wt % or less (excluding 0%), and the balance of iron (Fe) and inevitable impurities, the slab having a composition index of sensitivity expressed by Formula 1 below within the range of 3.4 or less, $$-0.451+34.131*P+111.152*Al-799.483*B+0.526*Cr3.4 \quad \text{[Formula 1]}$$

(where each of [P], [Al], [B], and [Cr] is the weight percent (wt %) of the corresponding element);

reheating the slab to a temperature within a range of 1050° C. to 1250° C.;

hot rolling the reheated slab to obtain a hot-rolled steel material; and cooling the hot-rolled steel material.

Reheating of Slab

A slab is reheated in a heating furnace to a temperature of 1050° C. to 1250° C. for a hot rolling process.

If the reheating temperature is too low, that is, lower than 1050° C., the load acting on a rolling mill may be markedly increased, and alloying elements may not be sufficiently dissolved in the slab. Conversely, if the reheating temperature is too high, grains may excessively grow to cause a strength decrease, and the reheating temperature may be higher than the temperature of the solidus curve of the slab to cause poor rollability. Therefore, it may be preferable that the upper limit of the reheating temperature be 1250° C.

Hot Rolling

A hot rolling process is performed on the reheated slab to obtain a hot-rolled steel material.

The hot rolling process may include a rough rolling process and a finish rolling process.

Preferably, the temperature of the hot finish rolling process may be adjusted to be within the range of 800° C. to 1050° C. If the hot rolling temperature is less than 800° C., a great rolling load may be applied, and if the hot rolling temperature is greater than 1050° C., an intended degree of strength may not be obtained because of coarse grains. Thus, it may be preferable that the upper limit of the hot rolling temperature be set to be 1050° C.

Cooling

The hot-rolled steel material obtained through the hot rolling process is cooled.

After the finish rolling process, the hot-rolled steel material may be cooled at a sufficiently high cooling rate to suppress the formation of carbides along grain boundaries. If the cooling rate is less than 10° C./s, the formation of carbides may not be sufficiently suppressed, and thus carbides may precipitate along grain boundaries during cooling. This may cause problems such as premature fracture, a ductility decrease, and a wear resistance decrease. Therefore, the cooling rate may be adjusted to be as high as possible, and the upper limit of the cooling rate may not be limited to a particular value as long as the cooling rate is within an accelerated cooling rate range. However, since it is generally difficult to increase the cooling rate of accelerated cooling to be greater than 100° C./s, it may be preferable that the upper limit of the cooling rate of the cooling process be set to be 100° C./s.

When the hot-rolled steel material is cooled, a cooling stop temperature may preferably be set to be 600° C. or less. Although the steel material is cooled at a high cooling rate, if the cooling of the steel material is stopped at a high temperature, carbides may be formed and grown in the steel material.

MODE FOR INVENTION

Hereinafter, the present disclosure will be described more specifically through examples. However, the following examples should be considered in a descriptive sense only and not for purpose of limitation. The scope of the present invention is defined by the appended claims, and modifications and variations reasonably made therefrom.

EXAMPLES

Slabs satisfying compositions shown in Table 1 below were reheated to 1200° C. and were hot rolled under the hot finish rolling conditions shown in Table 1 below to manufacture hot-rolled steel materials having a thickness of 12 mm. Then, the hot-rolled steel materials were cooled to 300° C. at a cooling rate of 20° C./s The grain size, yield strength, tensile strength, elongation, and crack sensitivity of the hot-rolled steel sheets (steel materials) manufactured as described above were measured, and results thereof are shown in Table 2 below.

The crack sensitivity is a reference for checking the hot workability of the steel materials, and as shown in FIG. 2, the surface quality of a lateral edge, a leading edge, and an upper surface of each of the steel materials were measured to evaluate the crack sensitivity. The degree of sensitivity of each measurement portion was scored according to references shown in FIG. 1, and the product of scores of the three portions was shown as sensitivity in Table 2 below. In Table 2 below, if the sensitivity is 3 or less, it is determined as having good surface quality.

In addition, Table 2 below shows a composition index of sensitivity which is −0.451+34.131*P+111.152*Al −799.483*B+0.526*Cr.

In addition, a relationship between the sensitivity and the composition index of sensitivity which is −0.451+34.131*P+111.152*Al−799.483*B+0.526*Cr, shown in Table 2, is illustrated in FIG. 3.

TABLE 1

| | Composition (wt %) | | | | | | | | | Finish rolling temperature |
|---|---|---|---|---|---|---|---|---|---|---|
| No. | C | Mn | Si | P | S | N | Al | B | Cr | (° C.) |
| *E1 | 0.42 | 20.3 | 0.21 | 0.016 | 0.004 | 0.015 | 0.028 | — | — | 870 |
| E2 | 0.46 | 25.0 | 0.29 | 0.016 | 0.004 | 0.020 | 0.026 | 0.0042 | 3.93 | 891 |
| E3 | 0.40 | 19.9 | 0.17 | 0.016 | 0.003 | 0.018 | 0.025 | 0.0023 | 2.05 | 930 |
| E4 | 0.39 | 21.6 | 0.19 | 0.017 | 0.007 | 0.019 | 0.025 | 0.0045 | 2.06 | 905 |
| E5 | 0.40 | 25.0 | 0.22 | 0.016 | 0.004 | 0.021 | 0.026 | — | — | 885 |
| E6 | 0.40 | 22.1 | 0.21 | 0.016 | 0.004 | 0.016 | 0.021 | 0.0030 | — | 940 |
| E7 | 0.39 | 19.6 | 0.18 | 0.018 | 0.009 | 0.018 | 0.022 | 0.0038 | 2.03 | 938 |
| E8 | 1.10 | 17.9 | 0.21 | 0.018 | 0.004 | 0.018 | 0.028 | 0.0040 | 2.70 | 937 |
| *CE1 | 0.40 | 22.0 | 0.19 | 0.029 | 0.004 | 0.018 | 0.026 | — | — | 922 |
| CE2 | 0.40 | 22.1 | 0.18 | 0.027 | 0.003 | 0.017 | 0.072 | 0.0037 | — | 938 |
| CE3 | 0.40 | 22.2 | 0.20 | 0.015 | 0.004 | 0.017 | 0.051 | — | — | 894 |
| CE4 | 0.40 | 22.2 | 0.20 | 0.030 | 0.003 | 0.017 | 0.060 | — | — | 933 |
| CE5 | 0.40 | 22.1 | 0.22 | 0.030 | 0.003 | 0.018 | 0.059 | — | — | 885 |

*E: Example,
**CE: Comparative Example

TABLE 2

| | Surface quality | | Properties | | | |
|---|---|---|---|---|---|---|
| No. | Composition index | Sensitivity | Grain size (μm) | Yield strength (MPa) | Tensile strength (MPa) | Elongation (%) |
| *E1 | 3.21 | 1.00 | 28 | 371.4 | 977.4 | 50.9 |
| E2 | 1.70 | 1.00 | 37 | 427.1 | 871.5 | 59.3 |
| E3 | 2.11 | 1.00 | 32 | 350.6 | 946.0 | 55.9 |
| E4 | 0.39 | 1.00 | 33 | 358.9 | 905.3 | 57.1 |
| E5 | 2.98 | 1.50 | 26 | 360.5 | 918.0 | 27.0 |
| E6 | 0.03 | 1.50 | 43 | 329.9 | 896.6 | 56.0 |
| E7 | 0.64 | 1.50 | 29 | 344.1 | 933.7 | 45.9 |
| E8 | 1.50 | 2.25 | 31 | 508.3 | 1003.9 | 29.5 |
| **CE1 | 3.43 | 3.38 | 30 | 342.5 | 925.9 | 61.9 |
| CE2 | 5.52 | 3.38 | 40 | 325.5 | 887.0 | 53.1 |
| CE3 | 5.73 | 8.00 | 28 | 356.2 | 928.7 | 52.7 |
| CE4 | 7.24 | 8.00 | 35 | 339.0 | 920.0 | 61.4 |
| CE5 | 7.13 | 8.00 | 33 | 352.5 | 899.9 | 39.2 |

*E: Example,
**CE: Comparative Example

As shown in Tables 1 and 2 above, Examples 1 to 8 had good surface quality because the sensitivity thereof was within the range of 3 or less as proposed in the present disclosure.

Comparative Example 1, having a high content of phosphorus (P), had relatively high crack sensitivity, that is, a composition index of 3.43.

Comparative Example 2 to which boron (B) was added had a decreased composition index because of a relatively high aluminum (Al) content and thus, decreased crack sensitivity. However, the composition index and crack sensitivity of Comparative Example 2 were outside of the ranges proposed in the present disclosure.

Comparative Example 3, having an aluminum (Al) content outside of the range proposed in the present disclosure, had a composition index of 5.73 and a crack sensitivity of 8.00.

Comparative Examples 4 and 5 had a relatively high composition index and crack sensitivity because of the addition of phosphorus (P) and aluminum (Al).

In addition, as illustrated in FIG. 3, when the composition index of sensitivity expressed by −0.451+34.131*P+111.152*Al−799.483*B+0.526*Cr was 3.4 or less, sensitivity of 3 or less was obtained, that is, good surface quality was obtained.

While embodiments have been shown and described above, it will be apparent to those skilled in the art that modifications and variations could be made without departing from the scope of the present invention as defined by the appended claims.

The invention claimed is:

1. A non-magnetic steel material, the non-magnetic steel material comprising manganese (Mn): 15 wt % to 27 wt %, carbon (C): 0.1 wt % to 1.1 wt %, silicon (Si): 0.05 wt % to 0.50 wt %, phosphorus (P): more than 0 wt % and 0.03 wt % or less, sulfur (S): more than 0 wt % and 0.01 wt % or less, aluminum (Al): 0.021 wt % to 0.050 wt %, chromium (Cr): 5 wt % or less, boron (B): 0.01 wt % or less, nitrogen (N): more than 0 wt % and 0.1 wt % or less, and a balance of iron (Fe) and inevitable impurities, wherein the non-magnetic steel material has a composition index of sensitivity expressed by Formula 1 below within a range of 3.4 or less, $$-0.451+34.131*P+111.152*Al-799.483*B+0.526*Cr\leq 3.4 \quad \text{[Formula 1]}$$

where each of [P], [Al], [B], and [Cr] is a weight percent (wt %) of a corresponding element, wherein the non-magnetic steel material has a microstructure comprising austenite in an area fraction of 95% or greater, and wherein the austenite has an average grain size of 10 μm or greater.

2. The non-magnetic steel material of claim 1, wherein the non-magnetic steel material comprises 15 wt % to 25 wt % of manganese (Mn).

3. The non-magnetic steel material of claim 1, wherein the non-magnetic steel material comprises 17 wt % to 25 wt % of manganese (Mn).

4. The non-magnetic steel material of claim 1, wherein the non-magnetic steel material comprises 0.1 wt % to 1.0 wt % of carbon (C).

5. The non-magnetic steel material of claim 1, wherein the non-magnetic steel material comprises 0.1 wt % to 0.8 wt % of carbon (C).

6. The non-magnetic steel material of claim 1, wherein the non-magnetic steel material comprises 0 wt % to 4 wt % of chromium (Cr).

7. The non-magnetic steel material of claim 1, wherein the non-magnetic steel material comprises 0.001 wt % to 4 wt % of chromium (Cr).

8. The non-magnetic steel material of claim 1, wherein the non-magnetic steel material comprises 0.0005 wt % or greater of boron (B).

9. The non-magnetic steel material of claim 1, wherein the non-magnetic steel material comprises 0.001 wt % to 0.06 wt % of nitrogen (N).

10. The non-magnetic steel material of claim 1, wherein the non-magnetic steel material comprises 0.005 wt % to 0.03 wt % of nitrogen (N).

11. A method for manufacturing the non-magnetic steel material of claim 1, the method comprising:

preparing a slab, the slab comprising manganese (Mn): 15 wt % to 27 wt %, carbon (C): 0.1 wt % to 1.1 wt %, silicon (S): 0.05 wt % to 0.50 wt %, phosphorus (F): more than 0 wt % and 0.03 wt % or less, sulfur (S): more than 0 wt % and 0.01 wt % or less, aluminum (Al): 0.021 wt % to 0.050 wt % or less, chromium (Cr): 5 wt % or less, boron (B): 0.01 wt % or less, nitrogen (N): more than 0 wt % and 0.1 wt % or less, and a balance of iron (Fe) and inevitable impurities, the slab having a composition index of sensitivity expressed by Formula 1 below within a range of 3.4 or less, $$-0.451+34.131*P+111.152*Al-799.483*B+0.526*Cr<3.4 \quad \text{[Formula 1]}$$

where each of [P], [Al], [B], and [Cr] is a weight percent (wt %) of a corresponding element;

reheating the slab to a temperature within a range of 1050° C. to 1250° C.;

hot rolling the reheated slab to obtain a hot-rolled steel material; and cooling the hot-rolled steel material, thereby producing the non-magnetic steel material of claim 1.

12. The method of claim 11, wherein the hot rolling of the reheated slab is performed at a hot finish rolling temperature of 800° C. to 1050° C.

13. The method of claim 11, wherein the cooling of the hot-rolled steel material is performed at a cooling rate of 10° C/s to 100° C/s.

14. The method of claim 11, wherein the cooling of the hot-rolled steel material is stopped at a cooling stop temperature of 600° C. or less.

15. The method of claim 11, wherein the steel material has a microstructure comprising austenite in an area fraction of 95% or greater.

16. The method of claim 15, wherein the austenite has an average grain size of 10 μm or greater.

* * * * *